US005181686A

United States Patent [19]

Barthel

[11] Patent Number: 5,181,686

[45] Date of Patent: Jan. 26, 1993

[54] PAINTED ARTICLE SUPPORT APPARATUS

[76] Inventor: James R. Barthel, 532 Howard St., Belding, Mich. 48809

[21] Appl. No.: 842,265

[22] Filed: Feb. 27, 1992

[51] Int. Cl.[5] ..... A47B 91/00

[52] U.S. Cl. ..... 248/346; 248/173

[58] Field of Search ..... 248/346, 172, 173, 167, 248/436, 188.7, 176; 34/238, 239; 432/259

[56] References Cited

U.S. PATENT DOCUMENTS

| | | | |
|---|---|---|---|
| 2,030,775 | 2/1936 | Twiss | 248/167 |
| 2,252,963 | 8/1941 | Fahrenwald | 432/259 |
| 2,881,502 | 4/1959 | Dopera | 432/259 |
| 3,261,110 | 7/1966 | Fuentevilla | 34/237 |
| 4,184,840 | 1/1980 | Gamberg | 432/259 X |
| 4,824,063 | 4/1989 | Miller | 248/346 |

FOREIGN PATENT DOCUMENTS

| | | | |
|---|---|---|---|
| 6701135 | 7/1968 | Netherlands | 248/167 |

*Primary Examiner*—J. Franklin Foss
*Attorney, Agent, or Firm*—Leon Gilden

[57] ABSTRACT

A support housing includes a plurality of radially projecting arm members mounted to the support housing, with the arm members formed of a first and second arm each slidable relative to one another, with each arm including an orthogonally and upwardly oriented projection. A modification of the invention includes projections formed with a polymeric spring-biased tip to resiliently support a workpiece minimizing marring of the workpiece during a drying procedure.

3 Claims, 4 Drawing Sheets

PAINTED ARTICLE SUPPORT APPARATUS

BACKGROUND OF THE INVENTION

1. Field of the Invention

The field of invention relates to article support apparatus, and more particularly pertains to a new and improved painted article support apparatus wherein the same is arranged to position a painted article minimizing damage to the article during a drying procedure.

2. Description of the Prior Art

The drying of an article freshly painted requires the positioning of the article minimizing marring of the surface during a drying procedure. The instant invention attempts to overcome deficiencies of the prior art by providing a universally adaptable structure to accommodate workpieces of various configurations and shapes. Prior art structure for supporting painted articles is exemplified in U.S. Pat. No. 4,880,194 to Geise, et al. wherein an article support structure is arranged to mount various components thereon for cutting, painting, and the like utilizing a rectilinear framework.

U.S. Pat. No. 4,010,851 to Erikson sets forth a painter's canvas frame holder rack to mount painted canvases within the rack structure.

As such, it may be appreciated that there continues to be a need for a new and improved painted article support apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of support apparatus now present in the prior art, the present invention provides a painted article support apparatus wherein the same is arranged to horizontally position a painted workpiece for support thereof. As such, the general purpose of the present invention, which will be described subsequently in greater detail, is to provide a new and improved painted article support apparatus which has all the advantages of the prior art article support apparatus and none of the disadvantages.

To attain this, the present invention provides a support housing including a plurality of radially projecting arm members mounted to the support housing, with the arm members formed of a first and second arm each slidable relative to one another, with each arm including an orthogonally and upwardly oriented projection. A modification of the invention includes projections formed with a polymeric spring-biased tip to resiliently support a workpiece minimizing marring of the workpiece during a drying procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved painted article support apparatus which has all the advantages of the prior art article support apparatus and none of the disadvantages.

It is another object of the present invention to provide a new and improved painted article support apparatus which may be easily and efficiently manufactured and marketed.

It is a further object of the present invention to provide a new and improved painted article support apparatus which is of a durable and reliable construction.

An even further object of the present invention is to provide a new and improved painted article support apparatus which is susceptible of a low cost of manufacture with regard to both materials and labor, and which accordingly is then susceptible of low prices of sale to the consuming public, thereby making such painted article support apparatus economically available to the buying public.

Still yet another object of the present invention is to provide a new and improved painted article support apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
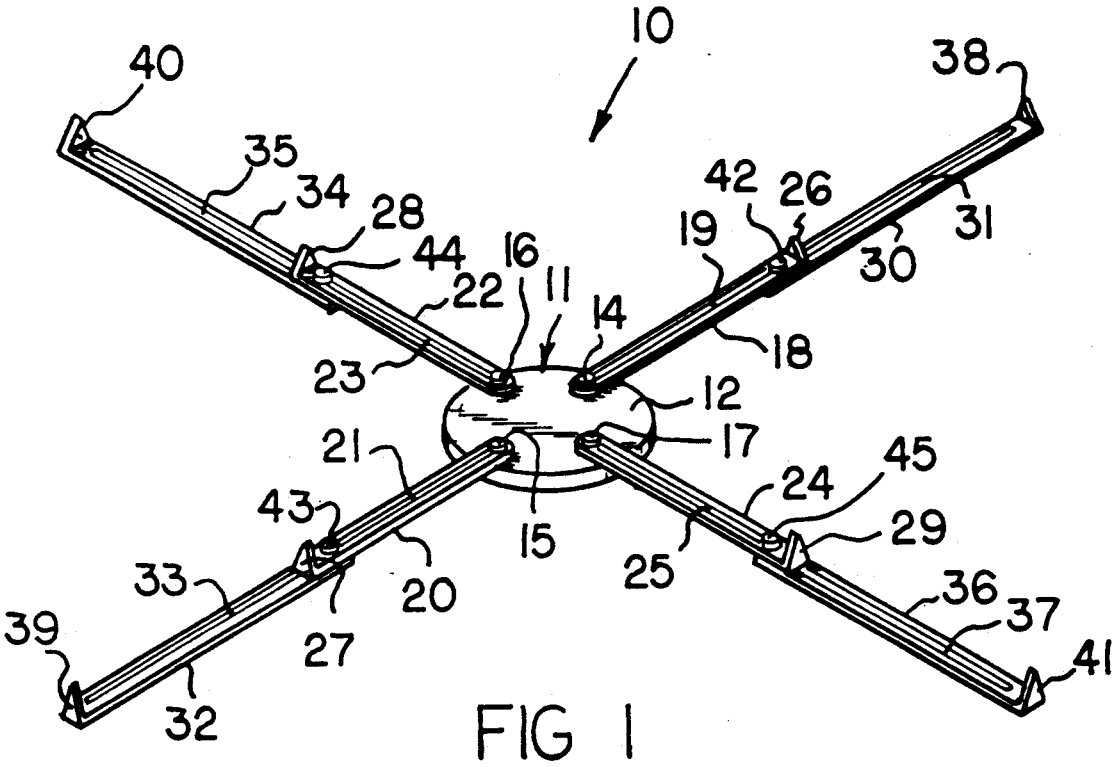
FIG. 1 is an isometric illustration of the instant invention.

With reference now to the drawings, and in particular to FIGS. 1 to 10 thereof, a new and improved painted article support apparatus embodying the principles and concepts of the present invention and generally designated by the reference numerals 10 and 10*a* will be described.

More specifically, the painted article support apparatus 10 of the instant invention essentially comprises a support housing 11 formed with a top wall 12 spaced from and parallel a bottom wall 13. Respective first, second, third, and fourth axles 14, 15, 16, and 17 are orthogonally directed into the top wall 12 extending thereabove, with the axles spaced substantially ninety degrees relative to one another adjacent the periphery of the top wall 12. A respective first, second, third, and fourth leg 18, 20, 22, and 24 are mounted to the respective first, second, third, and fourth axles 14, 15, 16, and 17. The first leg 18 includes a first leg slot 19 contained within the first leg 18. The second leg 20 includes a second leg slot 21 contained within the second leg 20, the third leg 22 includes a third leg slot 23 and similarly, the fourth leg 24 includes an elongate fourth leg slot 25. Each of the slots are directed substantially coextensively within the respective legs and are enclosed within each respective leg. A first leg projection 26 is orthogonally and integrally mounted to an outer distal end of the first leg 18 spaced from the first axle 14. The second leg projection 27 is integrally and orthogonally mounted to an outer distal end of the second leg 20, the third leg projection 28 is integrally and orthogonally mounted to an outer distal end of the third leg 22, with a fourth leg projection 29 integrally and orthogonally mounted to an outer distal end of the fourth leg 24. A fifth leg 30 has its rear distal end pivotally mounted about a fifth axle 42 to an outer distal end of the first leg 18. A sixth leg 32 has its rear distal end pivotally mounted about a sixth axle 43 to the outer distal end of the second leg 20, a seventh leg 34 has its rear distal end pivotally mounted about a seventh axle 44 to the outer distal end of the third leg 22, and an eighth leg 36 has its rear distal end pivotally mounted about an eighth axle 45 to the outer distal end of the fourth leg 24. The fifth axle 42 is mounted through the first leg slot 19 and the fifth leg slot 31 that is oriented longitudinally of the fifth leg 30. The sixth axle 43 is pivotally and slidably mounted through the second leg slot 21 and the sixth leg slot 33 that in turn is longitudinally aligned relative to the sixth leg 32, a seventh leg slot 35 longitudinally oriented through the seventh leg 34 receives the seventh axle 44 therethrough and through the third leg slot 23, and an eighth leg slot 37 longitudinally directed through the eighth leg 36 includes the eighth axle 45 directed therethrough and through the fourth leg slot 25 to provide for maximum orientation and positioning of the respective legs relative to one another. A fifth leg projection 38 is mounted to a forward distal end of the fifth leg 30 in an orthogonal orientation. A sixth leg projection 39 is orthogonally and integrally mounted to an outer distal end of the sixth leg 32, a seventh leg projection 40 is integrally and orthogonally mounted to an outer distal end of the seventh leg 34, and an eighth leg projection 41 is integrally and orthogonally mounted to an outer distal end of the eighth leg 36.

Figure 2:
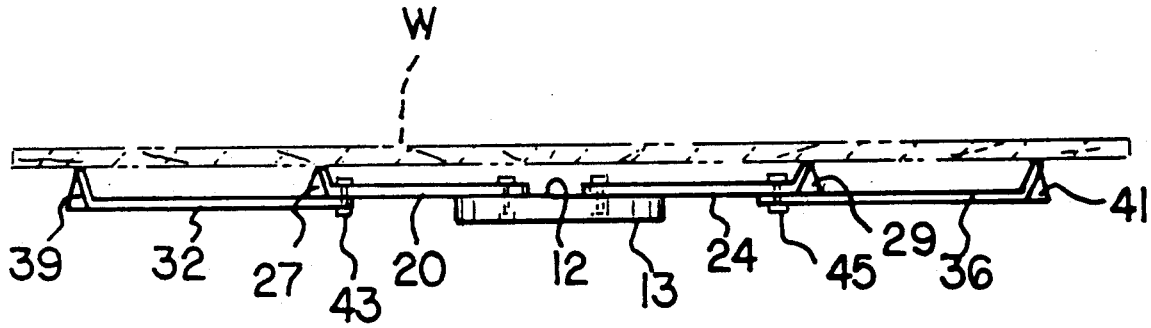
FIG. 2 is an orthographic side view of the instant invention.
Figure 3:
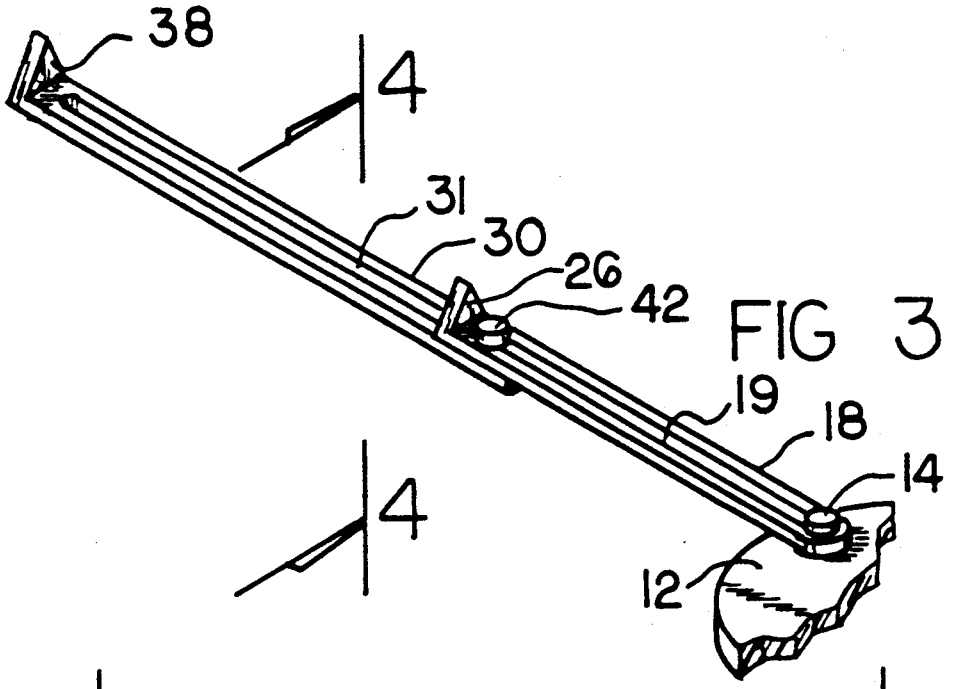
FIG. 3 is an isometric illustration of a single support arm assembly of the invention.
Figure 4:
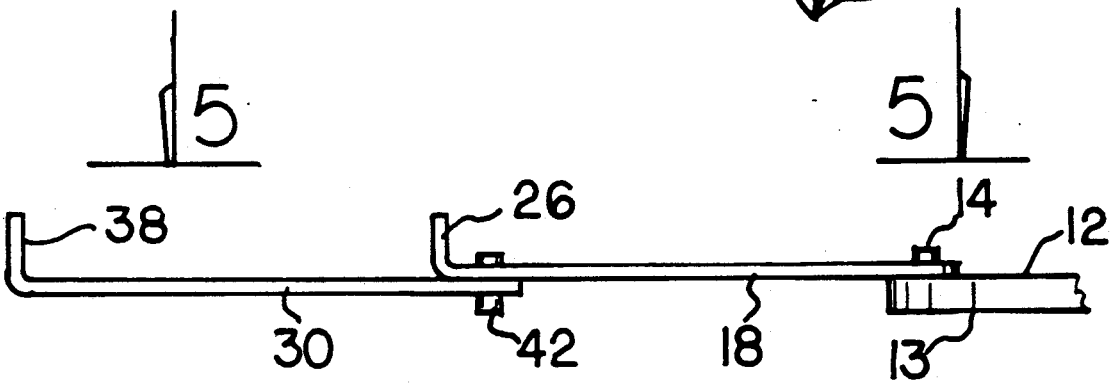
FIG. 4 is an orthographic view, taken along the lines 4—4 of FIG. 3 in the direction indicated by the arrows.
Figure 5:
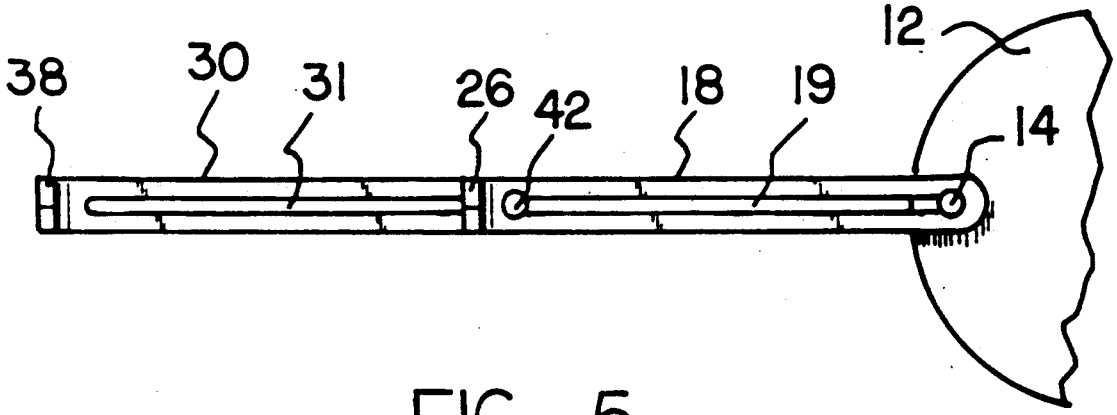
FIG. 5 is an orthographic view, taken along the lines 5—5 of FIG. 4 in the direction indicated by the arrows.
Figure 6:
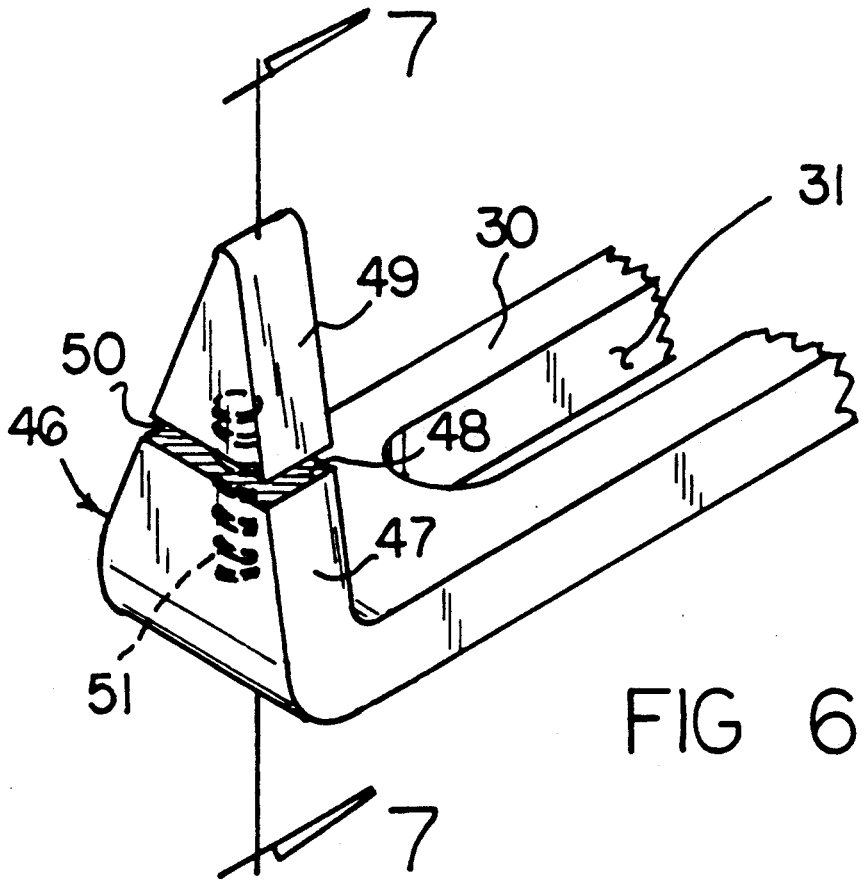
FIG. 6 is an isometric illustration of a modified support tip utilized by each arm of the invention.
Figure 7:
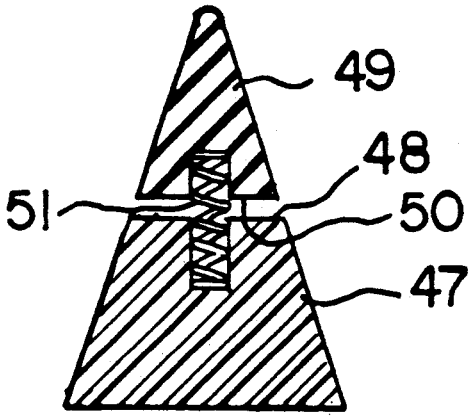
FIG. 7 is an orthographic view, taken along the lines 7—7 of FIG. 6 in the direction indicated by the arrows.

In each of the leg projections 38–41, as well as 26–29, the FIGS. 6 and 7 illustrate the use of modified projections 46 that may be utilized at each location as a substitute for the leg projections as depicted in FIG. 1. More specifically, the modified projections 46 each include a rigid projection base 47 formed with a base planar top wall 48 spaced from and parallel a resilient projection tip planar bottom wall 50 of a resilient projecting tip 49. The resilient tip 49 and the base 47 include a spring member 51 coaxially directed through the base 47 projecting through the base planar top wall 48 into the resilient projecting tip 49 through the planar bottom wall 50 to provide for biased and resilient accommodation of a workpiece "W" mounted on the apparatus, in a manner as illustrated in FIG. 2 for example.

Figure 8:
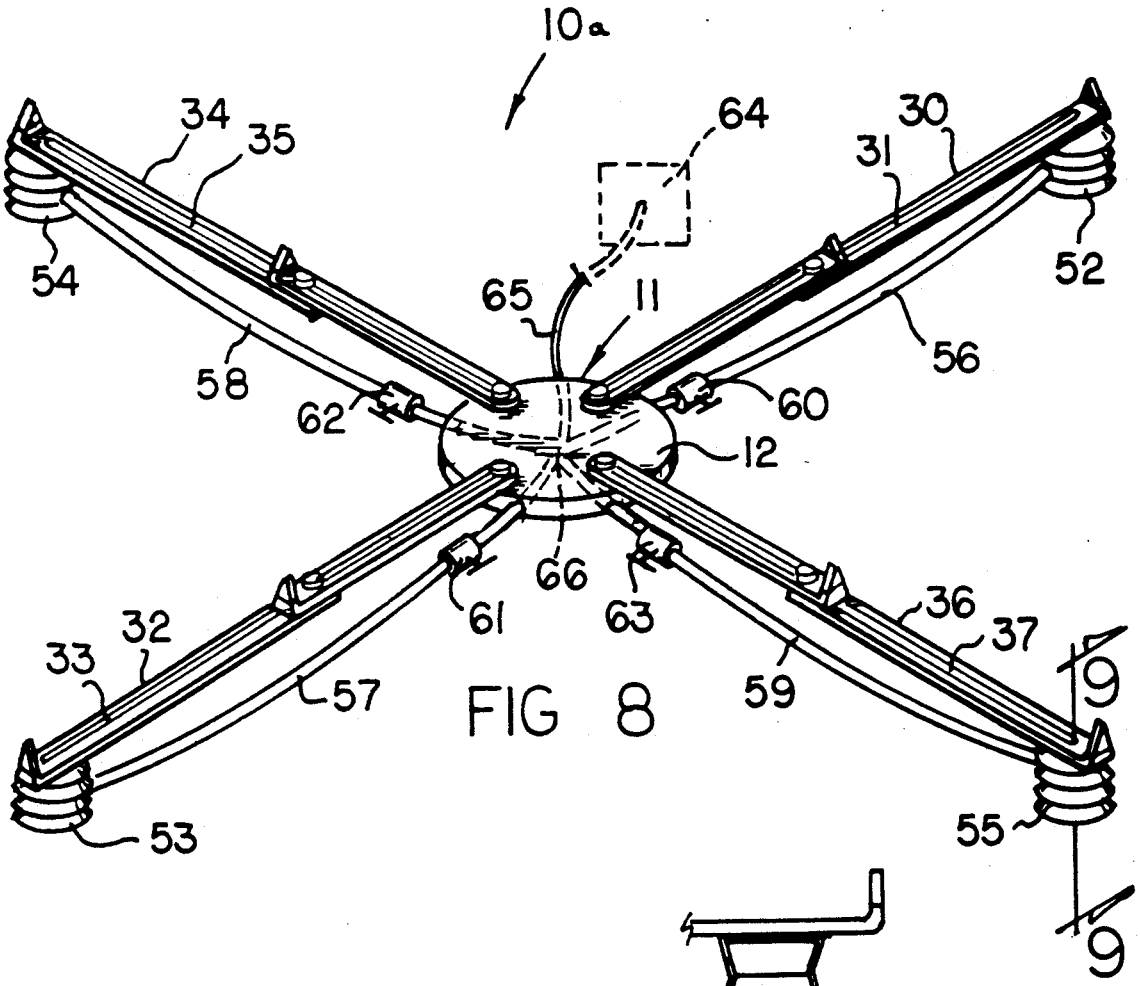
FIG. 8 is an isometric illustration of a modified support apparatus utilized by the invention.
Figure 9:
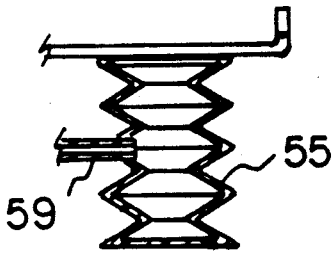
FIG. 9 is an orthographic view of a single pneumatic bellows utilized by each outer arm of each arm assembly.
Figure 10:
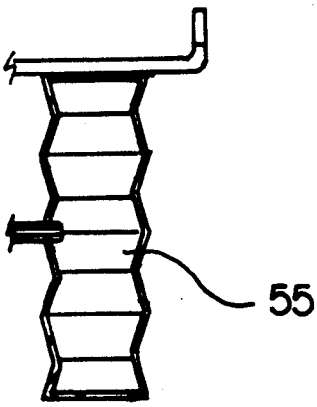
FIG. 10 is an orthographic view of the bellows in an expanded configuration.

The FIGS. 8 and 9 illustrate the use of the modified apparatus 10*a* to further include, in addition to the resilient projections 46 at each forward distal end of the legs 18, 20, 22, 24, 30, 32, 34, and 36, the use of pneumatic bellows to permit lifting of each outer distal end of each of the fifth, sixth, seventh, and eighth legs upwardly to further accommodate various configurations of workpieces to project such workpieces in a spaced relationship relative to an underlying surface. In this regard, a first pneumatic bellows 52 is mounted below the outer distal end of the fifth leg 30 below the fifth leg projection, a second pneumatic bellows 53 is mounted below the outer distal end of the sixth leg 32 below the sixth leg projection, a third pneumatic bellows 54 is mounted below the outer distal end of the seventh leg 34 and the seventh projection 40, and a fourth pneumatic bellows 55 is mounted below the outer distal end of the eighth leg 36 and the eighth leg projection 41. A first pneumatic conduit is directed into the first pneumatic bellows 52 to include a first valve 60, a second pneumatic conduit 57 is directed into the second pneumatic bellows 53, including a second valve 61, a third pneumatic conduit 58 is directed into the third pneumatic bellows 54, with the third pneumatic conduit 57 including a third valve 62, and a fourth pneumatic conduit 59 directed into the fourth pneumatic bellows 55 includes a fourth valve 63. Each of the conduits 56–59 are merged into a conduit junction 66 within the support housing 11, with a supply conduit 65 in pneumatic communication with the conduit junction 66 directed form the conduit junction 66 exteriorly of the support housing 11 to a pneumatic air source 64 to permit selective inflation of one or all of the pneumatic bellows to accommodate various configurations of workpieces positioned upon the apparatus 10*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A painted article support apparatus, comprising, a support housing, the support housing including a bottom wall and a top wall spaced from and parallel the bottom wall, and the top wall including a top wall periphery, and a plurality of first axle members fixedly and orthogonally mounted to the top wall adjacent the periphery, and each of the first axle members includes a first leg, each first leg including a first leg rear end portion and a first leg forward end portion, and an elongate slot directed longitudinally through each leg rear end portion and forward end portion, and each slot receiving one of the axle members therethrough, and each forward end portion of each leg including a first projection fixedly and orthogonally mounted to the forward end portion of each leg projecting thereof above the top wall, and each leg includes a further leg, each further leg including a further leg forward end portion and a further leg rear end portion, and each further leg including a further leg slot longitudinally directed of each further leg between the further leg forward end portion and the further leg rear end portion, and a further axle directed through each further leg slot and the slot of said leg to slidably mount the further leg to the leg, and each further leg includes a further leg projection fixedly and orthogonally mounted to the further leg forward end portion of each further leg.

2. An apparatus as set forth in claim 1 wherein each projection includes a rigid projection base, each rigid projection base includes a base planar top wall, and a resilient projecting tip, each resilient projecting tip including a tip planar bottom wall positioned coextensively above one of said base planar top walls, and each base planar top wall includes a spring member orthogonally projecting above each base planar top wall received within one of said tip planar bottom walls to resiliently secure one of said resilient projecting tips to one of the rigid projection base.

3. An apparatus as set forth in claim 2 wherein each further leg includes a pneumatic bellows secured to a bottom surface thereof, and each bellows includes a pneumatic conduit, and each pneumatic conduit includes a valve to selectively direct air flow through each pneumatic conduit, and each pneumatic conduit directed into the support housing at a conduit junction, and a supply conduit directed into the conduit junction in pneumatic communication with the conduit junction and each pneumatic conduit with the supply conduit directed exteriorly of the support housing to a pressurized pneumatic air source.

* * * * *